US006759134B1

(12) United States Patent
Rosenberg

(10) Patent No.: US 6,759,134 B1
(45) Date of Patent: Jul. 6, 2004

(54) PROCESS OF FORMING A METALLIC ARTICLE HAVING A BLACK OXIDE/ CERAMIC SURFACE AND ARTICLES PRODUCED BY THE METHOD

(76) Inventor: Edward Rosenberg, 510 Goolsby Blvd., Deerfield Beach, FL (US) 33442

( * ) Notice: Subject to any disclaimer, the term of this patent is extended or adjusted under 35 U.S.C. 154(b) by 0 days.

(21) Appl. No.: 10/135,915

(22) Filed: Apr. 30, 2002

Related U.S. Application Data

(63) Continuation-in-part of application No. 09/761,111, filed on Jan. 17, 2001, now abandoned.

(51) Int. Cl.[7] ..... B32B 15/04

(52) U.S. Cl. ..... 428/472.1; 428/469; 428/472; 148/281; 148/670; 148/671; 148/712; 148/421; 420/417; 63/34

(58) Field of Search ..... 148/281, 670, 148/671, 712, 421; 420/417; 63/34; 428/469, 472, 472.1

(56) References Cited

U.S. PATENT DOCUMENTS 5,820,707 A * 10/1998 Amick et al. ..... 148/669

* cited by examiner

*Primary Examiner*—Andrew L. Oltmans
(74) *Attorney, Agent, or Firm*—M. K. Silverman; Yi Li

(57) ABSTRACT

A process for forming a metallic article having a black ornamental surface includes the steps of metallurgically providing an alloy containing between about 51 and 70 about percent by weight of titanium, between about 3 and about 17 percent by weight of niobium, and the balance of a metal selected from the group consisting of zirconium, tantalum, molybdenum, hafnium zirconium, chromium, and mixtures thereof. The alloy is then casted and/or metal worked into a workpiece having a desired geometry and surface texture. The workpiece thereof is then baked in a kiln or oven in a substantially air atmosphere of between about 450 and about 850 degrees C. for a period of between about one and about 29 minutes. Resultant of such baking, there is produced a durable black surface layer consisting substantially of an oxide of niobium which is adhered to the substrate of the workpiece which remains unoxidized.

9 Claims, No Drawings

PROCESS OF FORMING A METALLIC ARTICLE HAVING A BLACK OXIDE/ CERAMIC SURFACE AND ARTICLES PRODUCED BY THE METHOD

REFERENCE TO RELATED APPLICATION

This application is a continuation-in-part of application Ser. No. 09/761,111, filed Jan. 17, 2001 now abandoned.

BACKGROUND OF THE INVENTION

1. Technical Field

The present invention relates to a method of formation of a black ceramic surface layer or coating upon a substrate of an alloy of titanium.

2. Prior Techniques

The development of a color coating or surface upon titanium and alloys thereof has, in the prior art, been limited to the use of chemical and electrolytic means for the accomplishment of the same.

For example, U.S. Pat. No. 6,093,259 (2000) to Watanabe, et al entitled Color Development of Metallic Titanium, and Black and Colored Titanium Manufactured by this Method, teaches the treatment of developing color upon metallic titanium by treatment of the same with an alkali solution followed by the application of titanium nitrides to produce a finish or surface effect. The use of such titanium nitride powder occurs at temperatures in a range of 800 to 1200 degrees C. Variations thereof taught by Wantanabi include the use of lower temperatures (350 to 600 degrees C.), however for time periods in the range of five to ten hours. The invention of Wantanabi enables the application of a wide range of colors to surfaces of pure or essentially pure titanium, using the a treatment by said alkali solution at a first temperature followed by treatment with nitride powers at a second and higher temperature.

U.S. Pat. No. 5,876,633 (1999) to Coleman, entitled Electrochromic Metal Oxides teaches the use of a range of electro chemical potentials in the presence of mobile ions in combination with a tin oxide doped with electro chemically effective amounts of antimony or niobium in order to provide a range of chromic surface effects as a function of applied electrical potential.

A related teaching exists in U.S. Pat. No. 5,811,794 (1998) to Kurze.

U.S. Pat. No. 5,075,178 (1991) to Schmidt, et al, entitled Black Surface Layer on Light Metal, teaches the development of a black surface layer upon a light metal or alloys of titanium through the use of a particular electrolyte.

U.S. Pat. Nos. 5,820,707 (1998) and 5,868,879 (1999) both to Amick, et al, and both entitled Composite Article, Alloy and Method, teach the use of a mixed oxide ceramic made of selectable combinations of titanium, zirconium, hafnium, molybdenum and tantalum. The teachings of Amick, et al, while relating to oxidation of titanium rich alloys, entail process which operate at temperatures far in excess of that addressed herein and employ time periods for heating or baking which are far less than that contemplated in the present invention. Further, the processed titanium alloy; however, the focus of Amick is that of production of materials having particular application in medical, surgical and industrial applications. Yet further, there is no apparent recognition of the chromatic or ornamental aspects, if any, of the technology thereof. In particular Amick's only reference to color, as a consequence of his technology, is a reference to a blue-black oxide film which was produced in one of the embodimnents discussed in said U.S. Pat. No. 5,820,707. Further, the timeframe of baking used in the instant invention is materially less than in Amick. Also, no quenching is employed.

The present invention, unlike that above referenced to Wantanabi, does not require use of an alkali or other solution, nor does it include use of an electrolyte as in the case in Schmidt and Coleman referenced above. Accordingly, although Wantanabi and Schmidt make reference to the possibility of providing a black surface layer upon an alloy of titanium, the methodology thereof bears no relationship to that set forth herein.

The technology of Amick, while more closely related to that of the within inventor requires, as above noted, the use of zirconium as a part of its metal alloy substrate and, as,well, operates at both temperatures and within periods of exposure to such temperatures that, are entirely dissimilar to that taught herein.

This invention flows from the recognition that titanium and niobium constitute the most necessary elements of a substrate alloy required in a low temperature, non-electrolytic method to produce articles having an black ornamental finish or surface having broad application in the areas of jewelry, and casings and housings for industrial products, this at a cost well below that of black anodization of steel.

SUMMARY OF THE INVENTION

The instant invention relates to a process for forming a metallic article having a black ornamental surface. This process comprises the steps of metallurgically providing an alloy containing between about 51 and 70 about percent by weight of titanium, between about 3.0 and about 17 percent by weight of niobium, and the balance of a metal selected from the group consisting of zirconium, tantalum, molybdenum, hafnium, or chromium, and mixtures thereof. Said alloy is then casted and/or metal worked into a workpiece having a desired geometry and surface texture. The workpiece thereof is then baked in a kiln or oven in a substantially air atmosphere of between about 450 and about 850 degrees C. for a period of between about one and about 29 minutes. Resultant of such baking, there is produced a luminous and durable black surface layer consisting substantially of an oxide of niobium which is adhered to the substrate of the workpiece which remains unoxidized.

It is accordingly an object of the invention to provide a cost-effective process of forming a metallic article having a black ornamental surface.

It is another object to provide a process of providing an article of the above type having sufficient strength, hardness, adherence to its substrate, and reflectivity value in the production of high value molded articles of jewelry and surfaces of casings or housings of industrial products.

It is a yet further object of the invention to provide a process of the above type for the production of such articles having a highly reflective black surface without requirement for use of chemicals, electrolytes, electricity, or complex heat treating apparatus.

The above and yet other objects and advantages of the present invention will become apparent from the hereinafter set forth Detailed Description of the Invention and Claims appended herewith.

DRAWINGS

None

DETAILED DESCRIPTION OF THE INVENTION

The present invention entails the usage of the metal titanium and niobium plus a metal selected from a periodic Group IV, V or VI metal to form an alpha alloy using a process of forming a metallic article having a black ornamental surface.

As an initial step in the present method there is provided a titanium and niobium base alloy, with a third metal, preferably zirconium, which is produced by traditional metallurgical processes requiring no special or costly equipment or treatments in the production thereof. Alloys of titanium and niobium of the type set forth herein may be readily formulated and provided by metallurgical contractors such a Teledyne Wah Chang, Albany, Oreg. Also, the generalized technology of such metallurgical formulation is taught in the above referenced U.S. Pat. No. 5,820,707 to Amick, et al which, to such extent, is hereby incorporated by reference. However, the present invention employs a much briefer baking time and lower proportion of niobium.

An alloy for use in accordance with the present invention contains between 51 and about 65 percent by weight of titanium, between about 10 and about 17 percent by weight of niobium, and 25 to 35 percent thereof is selected from one or more periodic Groups IV, V, or VI metals. For example, in Group IV, zirconium or hafnium may be used; in Group V vanadium or tantalum may be used; and in Group VI chromium or molybdenum may be utilized. In that titanium is a Group IV metal and niobium is a Group V metal, the residual amount of selectable metal will typically constitute zirconium or hafnium in Group IV and/or vanadium or tantalum in Group V.

Percents by weight of alloys of titanium, niobium and zirconium, within the baking period of 1–55 minutes, which have been found to be suitable for use in the present process are as follows:

TABLE A

| | Ti | Nb | [[Zn]] Zr |
|---|---|---|---|
| Alloy 1 | 50 | 15 | 35 |
| Alloy 2 | 53 | 10 | 37 |
| Alloy 3 | 54 | 10 | 36 |
| Alloy 4 | 55.5 | 8.5 | 36 |
| Alloy 5 | 56 | 9 | 35 |
| Alloy 6 | 56 | 10 | 34 |

TABLE B

| | Ti | Nb | [[Zn]] Zr |
|---|---|---|---|
| Alloy 7 | 55 | 10 | 35 |
| Alloy 8 | 57 | 13 | 30 |
| Alloy 9 | 58 | 10 | 32 |
| Alloy 10 | 59 | 10 | 31 |
| Alloy 11 | 60 | 10 | 30 |
| Alloy 12 | 65 | 7 | 38 |

TABLE C

| | Ti | Nb | [[Zn]] Zr |
|---|---|---|---|
| Alloy 13 | 65 | 4 | 31 |
| Alloy 14 | 67 | 3 | 30 |
| Alloy 15 | 87 | 13 | 20 |
| Alloy 16 | 70 | 10 | 20 |
| Alloy 17 | 50.5 | 17 | 32.5 |

TABLE D

| | |
|---|---|
| Titanium | 40% |
| Niobium | 10% |
| Hafnium | 5% |
| Vanadium | 25% |
| Chromium | 20% |

TABLE E

| | |
|---|---|
| Titanium | 50% |
| Niobium | 10% |
| Tantalum | 5% |
| Molybdenum | 10% |
| Chromium | 15% |

After an alloy has been metallurgically formed in accordance with the above Examples, the product thereof is cast, die, forged, or otherwise metal worked into a workpiece of desired geometry if, as a part of the above-referenced custom formulation of the alloy, it is not originally formed into such geometry.

Following the metal forming or working of the workpiece into the desired geometry, there is typically applied a surface texture thereto which would be effected by buffing, grinding, polishing, or the like in order to maximize the smoothness and reflectivity of the surface, given that the primary application of the present process is that of providing an ornamental surface to personal products such as jewelry, and castings and housings of industrial products.

Following the metal forming, the workpiece is placed within a kiln or oven having a substantially air, that is, nitrogen and oxygen dominant atmosphere, at a temperature of between about 450 to about 850 degrees C. for a period of between about one to preferably about 29 minutes. However, variable results may be obtained up to about 55 minutes. In general, the longer is the period of placement of the workpiece within the kiln, the lower will be the temperature of the air atmosphere necessary to effect the desired result. Also, an increase in oxygen content will decrease treatment time, while a decrease in oxygen will increase treatment time.

Excessive baking, e.g. beyond one hour, will create burrs and rough edges and angles on the resultant black ceramic surface, as will temperatures above 900° C.

Resultant of the above process, there is obtained a durable black surface layer which has been analytically determined to consist substantially of oxides of niobium which are strongly adhered upon the substrate of the workpiece which has not been oxidized.

Inasmuch as niobium, a Group V metal, is primarily involved in such oxidation, the above-referenced selectable metal for the titanium-niobium alloy is therefore most advantageously another Group V metal, namely, vanadium or tantalum. Therefore, in a further embodiment of the invention, it is believed that the 4 to 17 percent by weight requirement of niobium may be replaced by 4 to 17 percent by weight requirement of any Group V metal or combinations of Group V metals namely, said vanadium, niobium and tantalum, with the balance (beyond the required amount of titanium and Group V metal) selected from the group consisting of zirconium, molybdenum, hafnium, chromium and combinations and mixtures thereof.

Where greater weight of the resultant product is desired, use of the higher atonic weight metals, namely, hafnium and tantalum is indicated. For extreme weight, one may employ a percentage of tungsten which is also a Group VI metal.

In accordance with the above, it has been found that a deep black, highly luminous and highly durable oxide of niobium, or other Group V metal, may be obtained through the use of a low temperature atmospheric kiln after the base alloy of titanium has been provided by a specialty metallurgical formulation contractor.

Alloys of titanium and niobium such as the above have been found to enjoy desirable properties over a wide range of applications. Such alloys also exhibit a low modulus of elasticity, excellent castability, and superplasticity at elevated temperatures, i.e., about 750 degrees C. Such alloys are readily weldable and machinable both before and after hardening.

Further, it has been found that alloys of titanium can be surfaced hardened by oxidation to a depth sufficient to produce very high wear resistance. As well, such a hardened layer is very adherent to the non-oxidized substrate thereof, a property that is employed in the invention.

The resultant alloy is, as well, non-toxic and non-carcinogenic and, as above noted, may be produced by traditional well-known metallurgical processes without requirement of costly treatment systems. It has been also found that these alloys may be formed and milled into essentially any shape including, without limitation, sheets, pipes, bars, rods, wires, and tubing. However, for purposes of the present use, it is only sheet-like and torodial (ring like) forms that are of interest.

After formation, such alloys are amenable to a variety of casting, molding, forging, extrusion, and other metal working processes. In investment casting, titanium alloys have been found to exhibit excellent detail reproduction.

In the prior art, many titanium alloys have required the inclusion of zirconium as an essential element thereof. However, this is not the case in the instant process wherein it has been found that other elements, e.g., hafnium Group IV, vanadium and tantalum (Group V) and chromium and molybdenum (Group VI) may, either singularly or in mixture or combination, be employed in lieu of zirconium. Alloys resultant from the above Examples have been found to be about 40 percent lighter than steel, while possessing properties of hardness and impact resistance which are comparable to steel. As well, such alloys are alpha alloys and are not subject to a ductile-to-brittle transition upon a sharp drop in temperature.

It has been appreciated that after an article in accordance with the present invention is formed, for the purposes of production, jewelry, diamonds, gems or the like may be mechanically secured thereto, as may be elements of patterns of noble metals, such as gold, silver and platinum.

While there has been and described the preferred embodiment of the instant invention it is to be appreciated that the invention may be embodied otherwise than is herein specifically shown and described and that, within said embodiment, certain changes may be made in the form and arrangement of the parts without departing from the underlying ideas or princles of this invention as set forth in the Claims appended herewith.

I claim:

1. A process of producing a jewelry having a luminous black surface, the process consisting essentially of the steps of:

(a) processing an alloy into a workpiece having a jewelry structure; said alloy containing between about 51 and about 70 percent by weight of titanium, between about 3 and about 17 percent by weight of niobium and the balance of a metal selected from the group consisting of zirconium, tantalum, molybdenum, hafnium, vanadium, chromium, and combinations thereof, and (b) baking said workpiece in a kiln in a substantially air atmosphere at a temperature of between about 450 to about 850 degrees Centigrade for a period of between about 1 to about 29 minutes;

whereby said jewelry having an ornamental luminous black surface is formed from the process.

2. The process of producing a jewelry having a luminous black surface of claim 1, wherein said balance of said metal consists of between about 20 and about 38 percent by weight of zirconium.

3. The process of producing a jewelry having a luminous black surface of claim 2, wherein said luminous black surface has a high wear resistance.

4. The process of producing a jewelry having a luminous black surface of claim 3, wherein said jewelry structure is a ring-like structure.

5. The process of producing a jewelry having a luminous black surface claim 4, wherein said jewelry structure further comprises a surface texture.

6. The process of producing a jewelry having a luminous black surface of claim 3, wherein said jewelry structure is a sheet-like structure.

7. The process of producing a jewelry having a luminous black surface of claim 6, wherein said jewelry structure further comprises a surface texture.

8. A jewelry having a luminous black surface made of a metal alloy comprising between about 51 and about 70 percent by weight of titanium, between about 3 and about 17 percent by weight of niobium and the balance of a metal selected from the group consisting of zirconium, tantalum, molybdenum, hafnium, vanadium, chromium, and combinations thereof; and said jewelry having a jewelry structure and an ornamental luminous black surface containing niobium oxide.

9. The jewelry having a luminous black surface of claim 8, wherein said balance of said metal consists of between about 20 and about 38 percent by weight of zirconium.

* * * * *